US011383136B2

(12) United States Patent
Steck et al.

(10) Patent No.: US 11,383,136 B2
(45) Date of Patent: Jul. 12, 2022

(54) CAMMING STEM SYSTEM

(71) Applicants: Jeremy Steck, Salt Lake City, UT (US); Garrett Harmsen, Salt Lake City, UT (US); Brent Barghahn, Salt Lake City, UT (US); Jacob Hall, Midway, UT (US)

(72) Inventors: Jeremy Steck, Salt Lake City, UT (US); Garrett Harmsen, Salt Lake City, UT (US); Brent Barghahn, Salt Lake City, UT (US); Jacob Hall, Midway, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 291 days.

(21) Appl. No.: 16/858,951

(22) Filed: Apr. 27, 2020

(65) Prior Publication Data

US 2021/0001181 A1 Jan. 7, 2021

Related U.S. Application Data

(60) Provisional application No. 62/840,532, filed on Apr. 30, 2019.

(51) Int. Cl.
*A63B 29/02* (2006.01)

(52) U.S. Cl.
CPC ..... *A63B 29/02* (2013.01); *A63B 29/024* (2013.01)

(58) Field of Classification Search
CPC .... A63B 29/02; A63B 29/024; A63B 2209/00
See application file for complete search history.

(56) References Cited

U.S. PATENT DOCUMENTS 4,572,464 A * 2/1986 Phillips ..... A63B 29/024 248/231.9
4,575,032 A * 3/1986 Taylor ..... A63B 29/024 248/231.21
4,643,377 A * 2/1987 Christianson ..... A63B 29/024 248/231.9
4,645,149 A * 2/1987 Lowe ..... A63B 29/024 248/231.9

(Continued)

FOREIGN PATENT DOCUMENTS

DE 10131854 A1 5/2003
GB 2419632 3/2006

*Primary Examiner* — David M Upchurch
(74) *Attorney, Agent, or Firm* — Trent Baker; Baker IP PLLC

(57) ABSTRACT

An improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The connection system is configured to create an elongated partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees.

20 Claims, 6 Drawing Sheets

(56) References Cited

U.S. PATENT DOCUMENTS 4,781,346 A * 11/1988 Banner ..... A63B 29/024 248/231.9
4,832,289 A 5/1989 Waggoner
4,923,160 A 5/1990 Waggoner
5,860,629 A 1/1999 Reed
6,042,069 A 3/2000 Christianson
6,092,773 A * 7/2000 Kieliszewski ..... A63B 29/024 248/231.9
6,283,426 B1 * 9/2001 Guthrie ..... A63B 29/024 248/231.91
6,375,139 B1 4/2002 Tucker
6,679,466 B2 1/2004 Brown
6,736,359 B2 5/2004 Murray
7,014,156 B2 3/2006 Apezetxea
7,140,583 B2 11/2006 Petzl
7,257,726 B2 10/2007 Tusting
7,278,618 B2 10/2007 Tusting
7,802,770 B2 9/2010 Field
7,959,119 B2 * 6/2011 Tusting ..... A63B 29/024 248/231.91
9,302,154 B2 * 4/2016 Steck ..... A63B 29/024
9,370,692 B2 * 6/2016 Czech ..... A63B 29/024
10,143,892 B2 * 12/2018 Baker ..... A63B 29/024
2003/0057337 A1 * 3/2003 Brown ..... A63B 29/024 248/231.9
2004/0035992 A1 * 2/2004 Watts ..... A63B 29/024 248/231.9
2005/0037023 A1 * 2/2005 Field, Jr. ..... A63B 29/024 424/195.15
2005/0098696 A1 * 5/2005 Lowe ..... A63B 29/024 248/231.9
2005/0218282 A1 6/2005 Phillips
2005/0161567 A1 * 7/2005 Tusting ..... A63B 29/024 248/231.9
2006/0231708 A1 * 10/2006 Robertson ..... A63B 29/024 248/231.9
2013/0334385 A1 * 12/2013 Steck ..... A63B 29/024 248/231.9
2015/0001360 A1 * 1/2015 Czech ..... A63B 29/024 248/231.9
2015/0290499 A1 * 10/2015 Baker ..... F16B 2/18 29/434
2018/0001175 A1 * 1/2018 Davidson ..... A63B 69/0048

* cited by examiner

CAMMING STEM SYSTEM

RELATED APPLICATIONS

This application claims priority to U.S. provisional application Ser. No. 62/840,532 filed Apr. 30, 2019, the contents of which are incorporated by reference.

FIELD OF THE INVENTION

The invention generally relates to active camming systems. In particular, the present invention relates to an improved camming stem system.

BACKGROUND OF THE INVENTION

Climbers generally use clean protection devices for two distinct purposes. First, a clean protection device may be used as a form of safety protection for protecting a climber in the event of a fall, and second, a clean protection device may intentionally be used to artificially support a climber's weight. Clean protection devices cam or wedge into a crack, hole, gap, orifice, taper, or recess in order to support an outward force. The surface on which the clean protection device supports the outward force is considered the protection surface. The protection surface can consist of natural materials such as rock, or it may consist of artificial materials such as concrete or wood.

Clean protection devices are generally divided into categories of active and passive. Passive protection devices include a single object which contacts the protection surface to support an outward force. For example, a wedge is a passive protection device because it has a single head with a fixed shape. There are numerous types of passive protection devices, including nuts, hexes, tri-cams, wedges, rocks, and chocks. Active protection devices include at least two movable parts that can move relative to one another to create a variety of shapes. For example, a slidable chock or slider nut is considered an active protection device because it includes two wedges that move relative to one another in order to wedge into crevices of various shapes and sizes. When the two wedges of the slider nut are positioned adjacent to one another, the overall width of the protection device is significantly larger than if the two wedges are positioned on top of one another. The two wedges must make contact with the protection surface in order to actively wedge the device within the protection surface.

A further subset of active protection is camming devices. These devices translate rotational displacement into linear displacement. Therefore, a slider chock would not be an active camming device because the two wedges simply slide relative to one another and do not rotate. Camming devices may include two, three, and four cam lobes. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

Unfortunately, one of the largest disadvantages of lightweight active protection devices is a lack of stem rigidity. The connection system connects the camming objects to some form of clip-in point or loop. The two most common connection systems used in three and four lobe cam units are single stem and double stem systems. Double stem systems include a U-shaped cable that attaches independently to two cable terminals on either end of the head of the protection device. The clip-in point of a double stem system is simply the bottom of the U-shaped cable. Single stem systems include a single cable that is attached to a single cable terminal located at the center of the head of the protection device. The single stem system generally includes some form of clip-in loop attached to the single cable. Alternatively, a clip-in loop can be created by coupling the single cable back to itself with some form of swage. Single stem connection systems are generally preferable because they are less likely to obstruct the placement of the camming device. However, one of the problems with single stem connection systems is a lack of sufficient rigidity when selectively switching between an extended state and a retracted state.

Therefore, there is a need in the industry for an active camming stem system that increases the stem rigidity while minimizing overall weight and maintaining the necessary strength and flexibility for optimal use.

SUMMARY OF THE INVENTION

The present invention relates to active camming systems. One embodiment of the present invention relates to an improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The connection system is configured to create an elongated, partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees. The first and second end of the twisted cable may be coupled to the head member orthogonal to the axle such that the first and second ends of the twisted cable are oriented orthogonal to the loop.

Embodiments of the present invention represent a significant advancement in the field of single stem active camming systems. The connection system of most conventional single stem camming systems includes at least one of a heavy rigid metal stem or over tube, an overly flexible single cable, and/or an awkward loop oriented orthogonal to the at least one axle. Conventional single stem camming systems generally include one or more undesirable characteristics in order to provide the necessary coupling and functionality. A metal rigid stem or over tube creates rigidity during retraction, but it adds significant weight to the system and is not optimally flexible in the extended state. An exposed single flexible cable creates flexibility during use in the extended state but often fails to provide the necessary rigidity during retraction. Embodiments of the present invention incorporate a novel use of a twisted cable to intercouple between the head member and loop so as to create an optimally oriented loop which is parallel to the axle. Orienting the loop parallel to the axle ensures that a user's thumb may optimally be placed in the loop during retraction of the trigger and cam lobes. The twisted cable includes a radial twisting angle of at least 90 degrees such that the two ends of the twisted cable are coupled to the head member orthogonal to the axle. The twisted cable maintains uniform radial rigidity of the stem. The twisted cable further provides the ability to swage the cables on top of each other orthogonal to the axles, allowing for a narrower head width, and lower weight than a single cable construction of equal strength.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to active camming systems. One embodiment of the present invention relates to an improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The connection system is configured to create an elongated, partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees. The first and second end of the twisted cable may be coupled to the head member orthogonal to the axle such that the first and second end of the twisted cable are oriented orthogonal to the loop. Also, while embodiments are described in reference to a single stem active camming system, it will be appreciated that the teachings of the present invention are applicable to other areas, including but not limited to other camming systems.

The following terms are defined as follows:

Definitions

Twisted cable—a cable having two ends, a loop, and a radial twisting angle of at least 90 degrees between the two ends and the loop.

Figure 1:
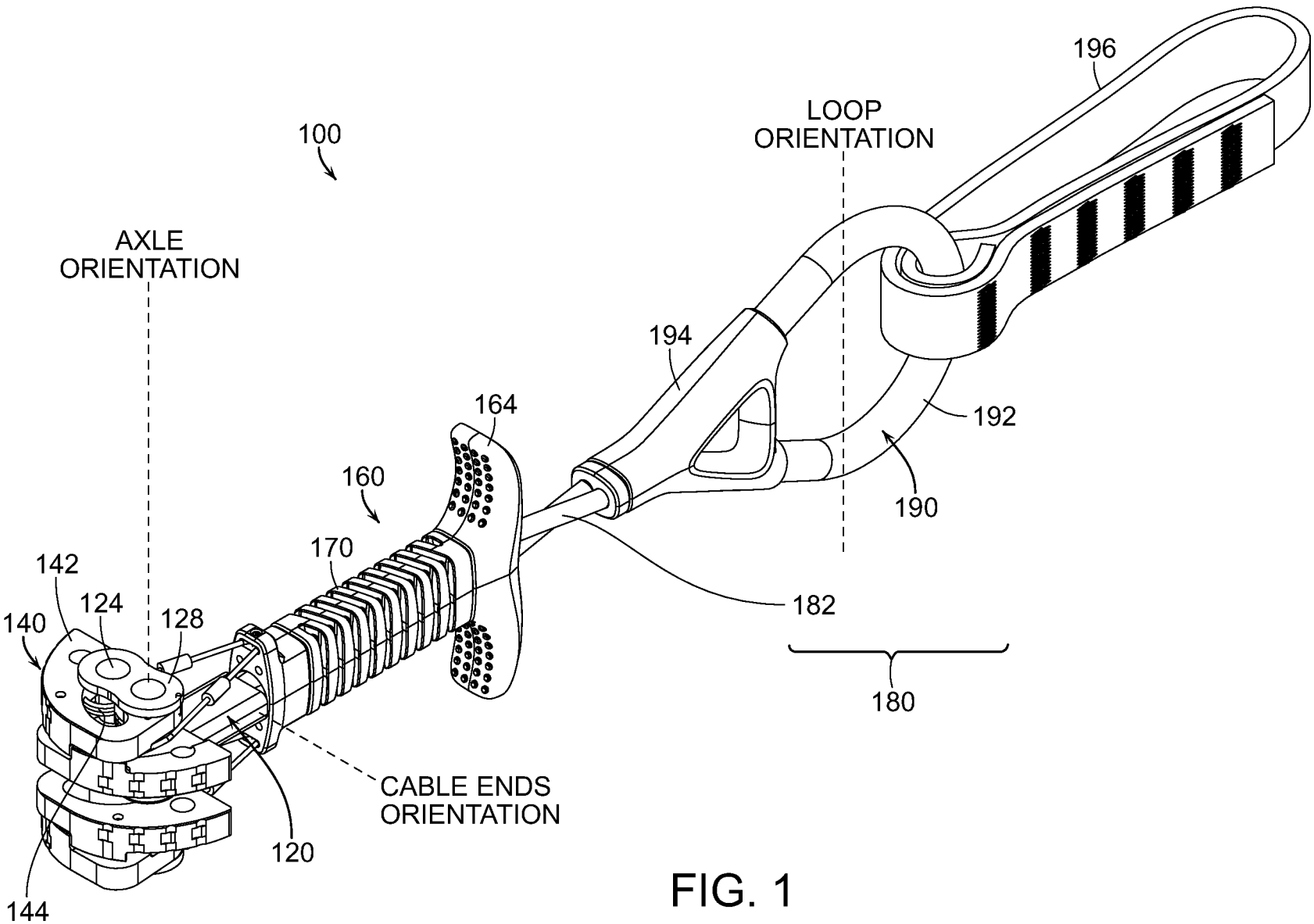
FIG. 1 illustrates a perspective view of a single stem active camming system in an extended state in accordance with embodiments of the present invention.
Figure 2:
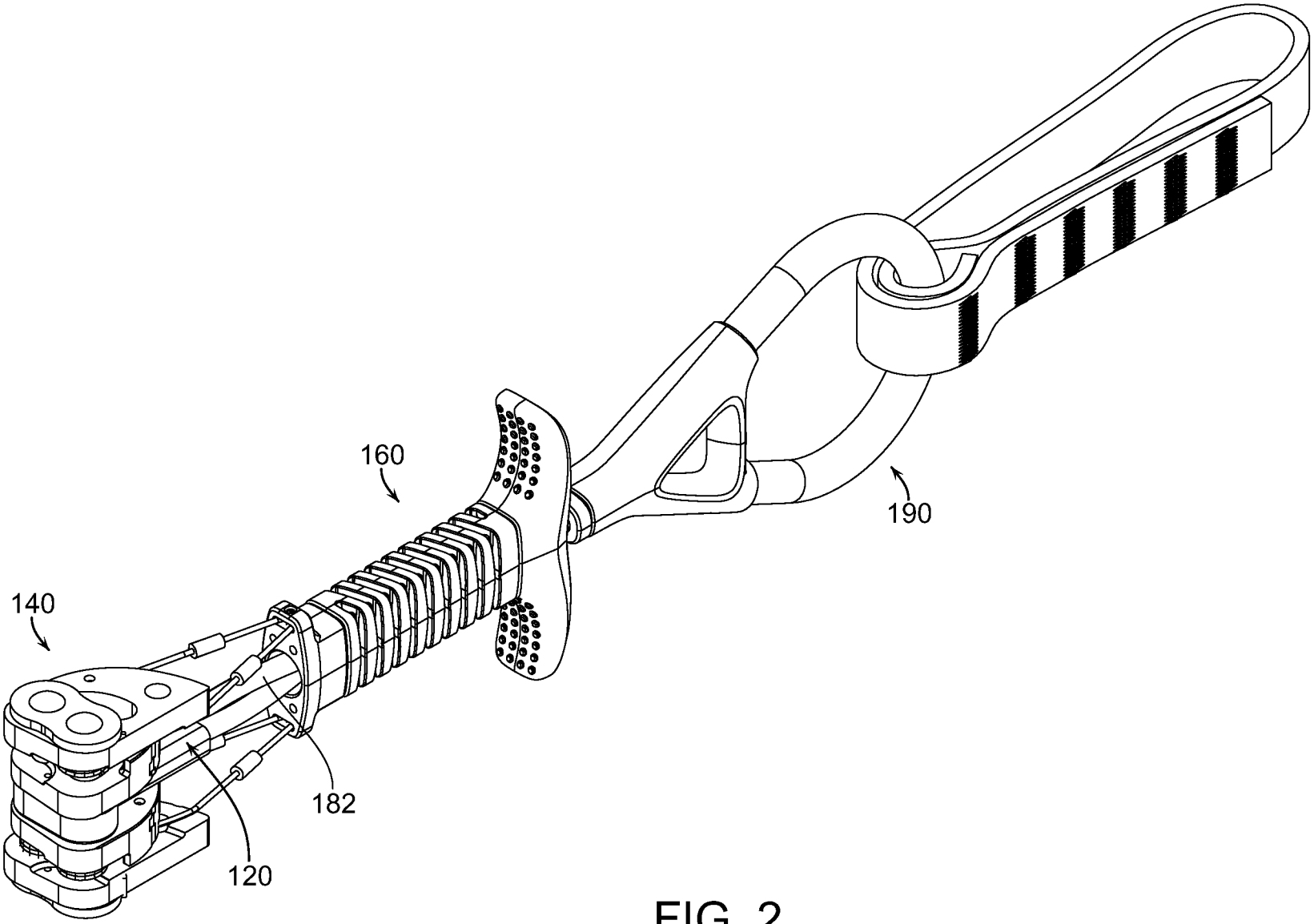
FIG. 2 illustrates a perspective view of a single stem active camming system in a retracted state in accordance with embodiments of the present invention.

Reference is initially made to FIGS. 1-2, which illustrate perspective views of a single stem active camming system in the extended and retracted states, respectively.

Reference is initially made to FIG. 1, which illustrates an active camming system designated generally at 100. The system includes a head member 120, cam lobes 140, a retraction system 160, and a connection system 180. The head member 120 further includes a first and second axle 124, a head (See FIG. 5), and a set of plates or axle separators 128. The head member 120 intercouples the cable 182 (described below with reference to connection system 180) and the axles 124. Non-illustrated alternative embodiments may incorporate a single axle without a plate or axle separator. The axles 124 are rigid cylindrical members which facilitate the rotation of the cam lobes 140 between extended and retracted states. The orientation of the axles refers to the lengthwise orientation. The Figures illustrate the cam lobes 140 in both the extended state (FIGS. 1,3, and 5) and the retracted state (FIGS. 2, 4, and 6). The axles 124 may comprise a rigid metal material configured to withstand various operational forces, including but not limited to shearing. The plates 128 rigidly intercouple the end regions of the axles 124 so as to support a particular spacing therebetween. The plates 128 are disposed on either side of the head member 120. The plates 128 may be composed of aluminum or steel and shaped in an oval configuration. The head is configured to at least partially cover a coupling region of the axles 124 between the cam lobes 140 and resist translation and rotation of the axles 124. The head 126 may be substantially T-shaped and composed of a rigid plastic or metal material.

The cam lobes 140 include independent lobes 142 and biasing springs 144. It will be appreciated that alternative non-illustrated embodiments may include other lobe configurations, including but not limited to two or three lobe systems. The lobes 142 are rotatably coupled to the axles 124 to facilitate rotation between the extended and retracted states (i.e. axis of rotation). The cam lobes 142 are each substantially quarter circle-shaped with a curved camming surface and are configured to rotate about a rotation point mathematically corresponding to the shape of the curved camming surface. The cam lobes 142 may be composed of a metal material including but not limited to aluminum and may incorporate various internal recesses, depressions, etc. The cam lobes 142 are biased in the extended state with respect to the axles with the biasing springs 144. The biasing springs 144 are intercoupled between the cam lobes 142 and the axles 124.

The retraction system 160 is coupled between the connection system 180 and the cam lobes 140 and is configured to enable the selective engagement of the retracted state from the biased extended state. The retraction system includes a trigger 164 and a trigger assembly 170. The trigger 164 is slidably coupled over the twisted cable 182 of the connection system 180. The trigger 164 is shaped to include two finger regions orthogonally extending from the elongated region of the connection system 180. The trigger 164 may be composed of a rigid plastic material. The trigger wires and trigger assembly 170 are coupled to the individual cam lobes 142 via retraction wires, but it will be appreciated that numerous non-illustrated couplings configurations may be incorporated. Although the illustrated embodiment includes a specific type of retraction system, it will be appreciated that the teaching of the present invention pertaining to the twisted cable may be implemented with other non-illustrated retraction systems such as direct trigger cables. The trigger 164 is configured to slide along the elongated region of the connection system 180 corresponding to the extended and retracted states of the cam lobes 140. In operation, a user may retract the trigger 164 away from the head member 120 to overcome the biasing force of the cam lobes 140 toward the extended state (FIG. 2). As the user continues to retract the trigger 164, the cam lobes 142 rotate about the axles 124 toward the retracted state.

The novel connection system 180 includes a twisted cable 182 with a set of ends, a loop 190, and a partially rigid region between the loop 190 and the head member 120. The twisted cable 180 may also be referred to simply as the cable 180. The two ends of the twisted cable 182 are coupled to the head portion of the head member 120 in a particular orientation. The twisted cable 182 also forms a loop 190 opposite the head member 120 on the system 100. It will be appreciated that the orientation of the loop 190 is parallel to the orientation of the axles 124 and orthogonal to orientation of the cable ends 184.

The components of the connection system 180 function synergistically for optimal operation of the retraction system 160. The twisted cable 182 is flexibly biased toward an elongated straight configuration as shown. The region between the loop 190 and the head member 120 may be referred to as a partially rigid region because of the optimal flexibility created by the retraction system 160. The twisted cable 182 may optionally route through a Y-shaped or V-shaped member or thumb rest 194 in which two portions of the twisted cable are initially separated. The medial portion of the twisted cable 182 forms the loop 190 within an optional U-shaped cover member 192. The optional U-shaped cover member 192 may assist in forming the loop 190 and protecting the loop 190 portion of the twisted cable 182 during operation. The twisted cable 182 is disposed within an internal channel of the optional U-shaped cover member 192.

Figure 3:
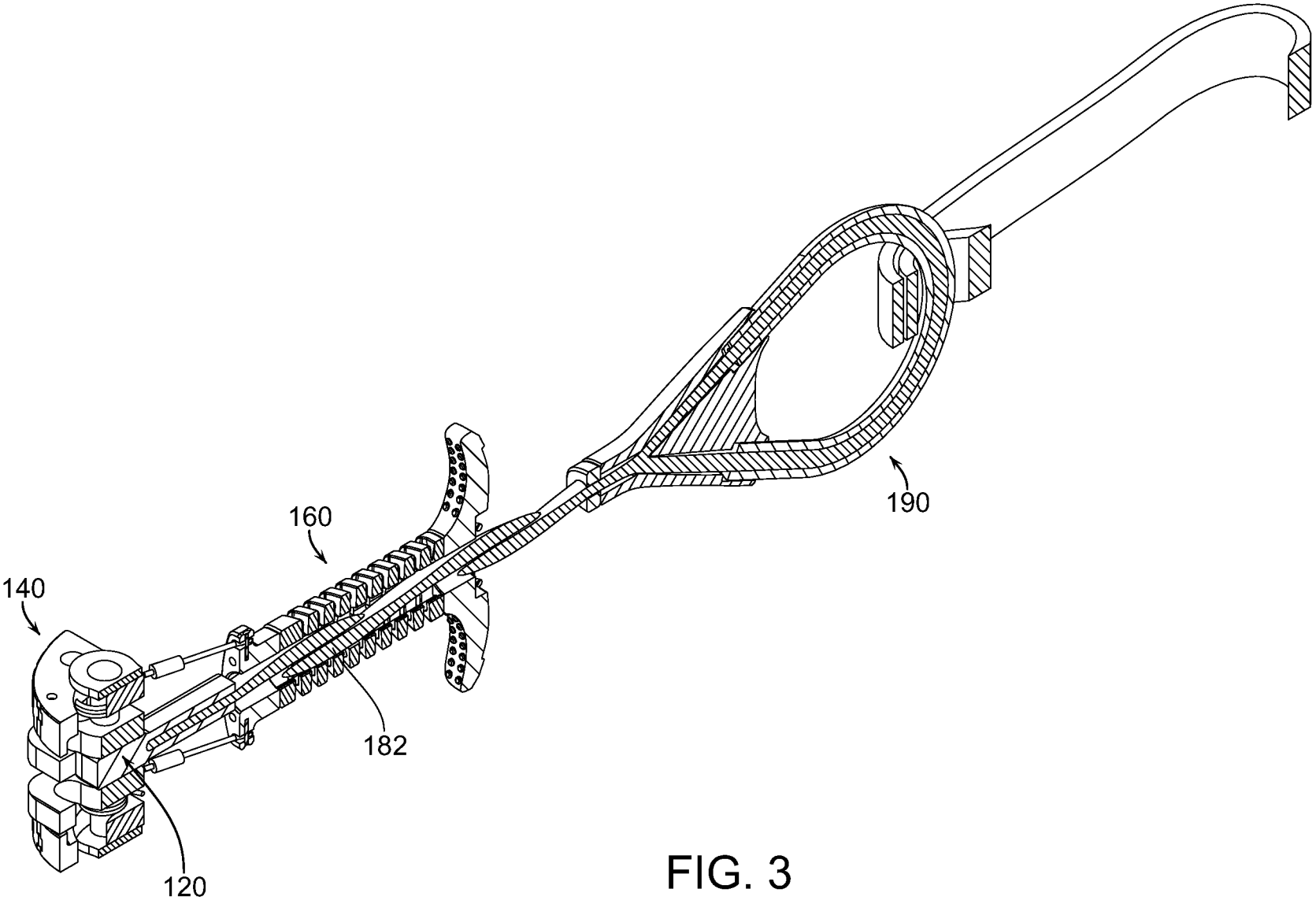
FIG. 3 illustrates a cross sectional perspective view of a single stem active camming system in an extended state in accordance with embodiments of the present invention.
Figure 4:
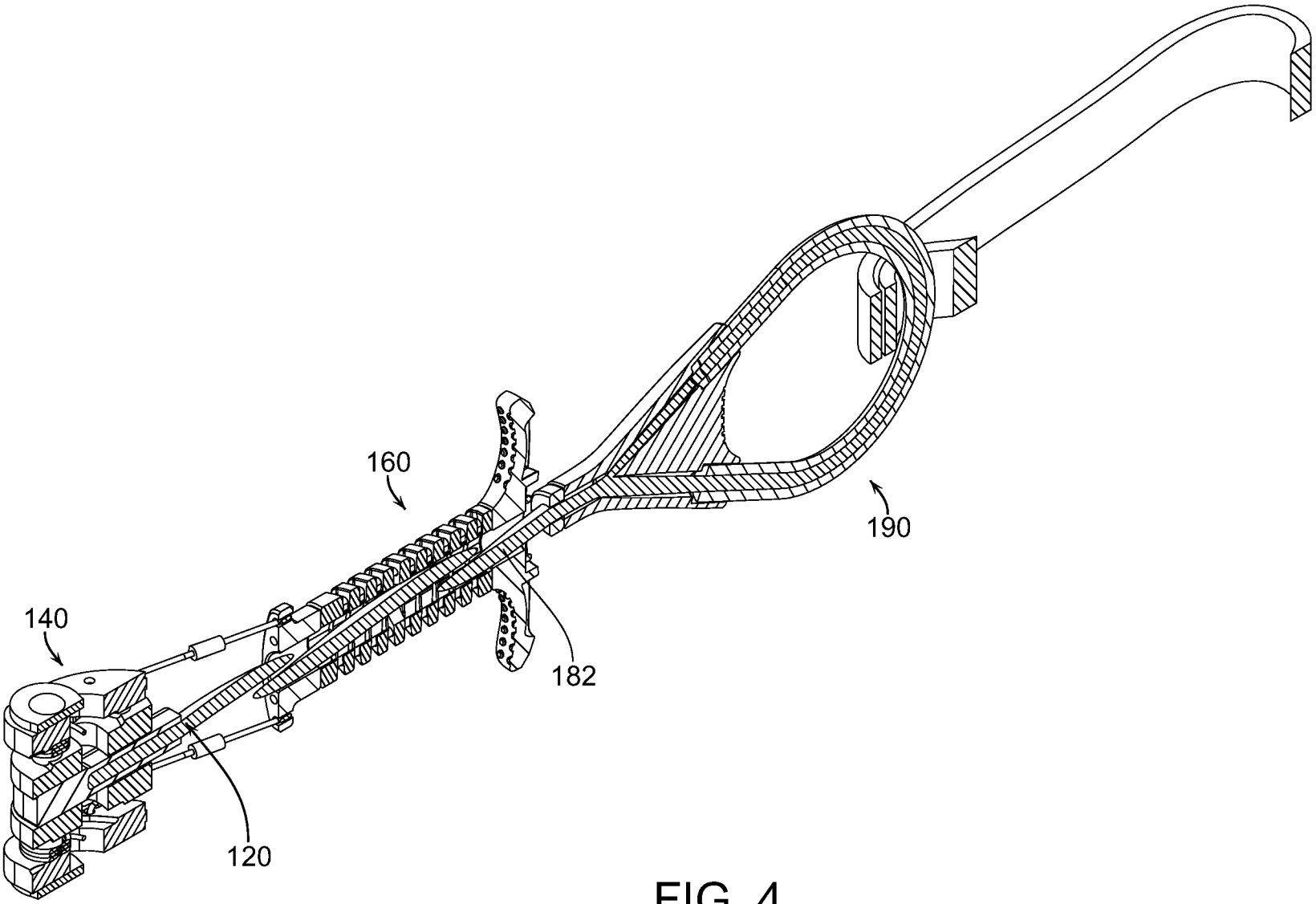
FIG. 4 illustrates a cross sectional perspective view of a single stem active camming system in a retracted state in accordance with embodiments of the present invention.
Figure 5:
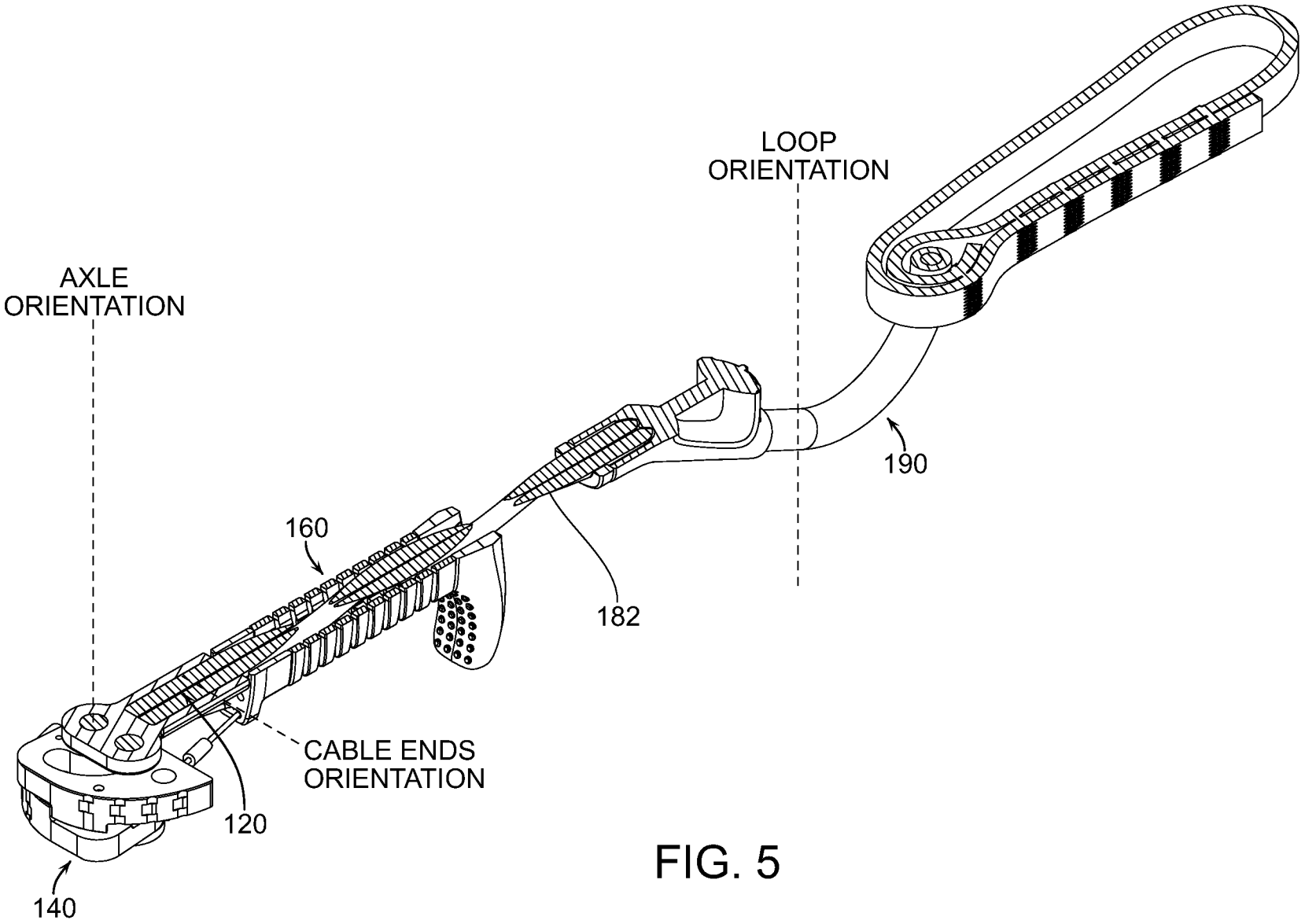
FIG. 5 illustrates an alternative, cross sectional perspective view of a single stem active camming system in an extended state in accordance with embodiments of the present invention.
Figure 6:
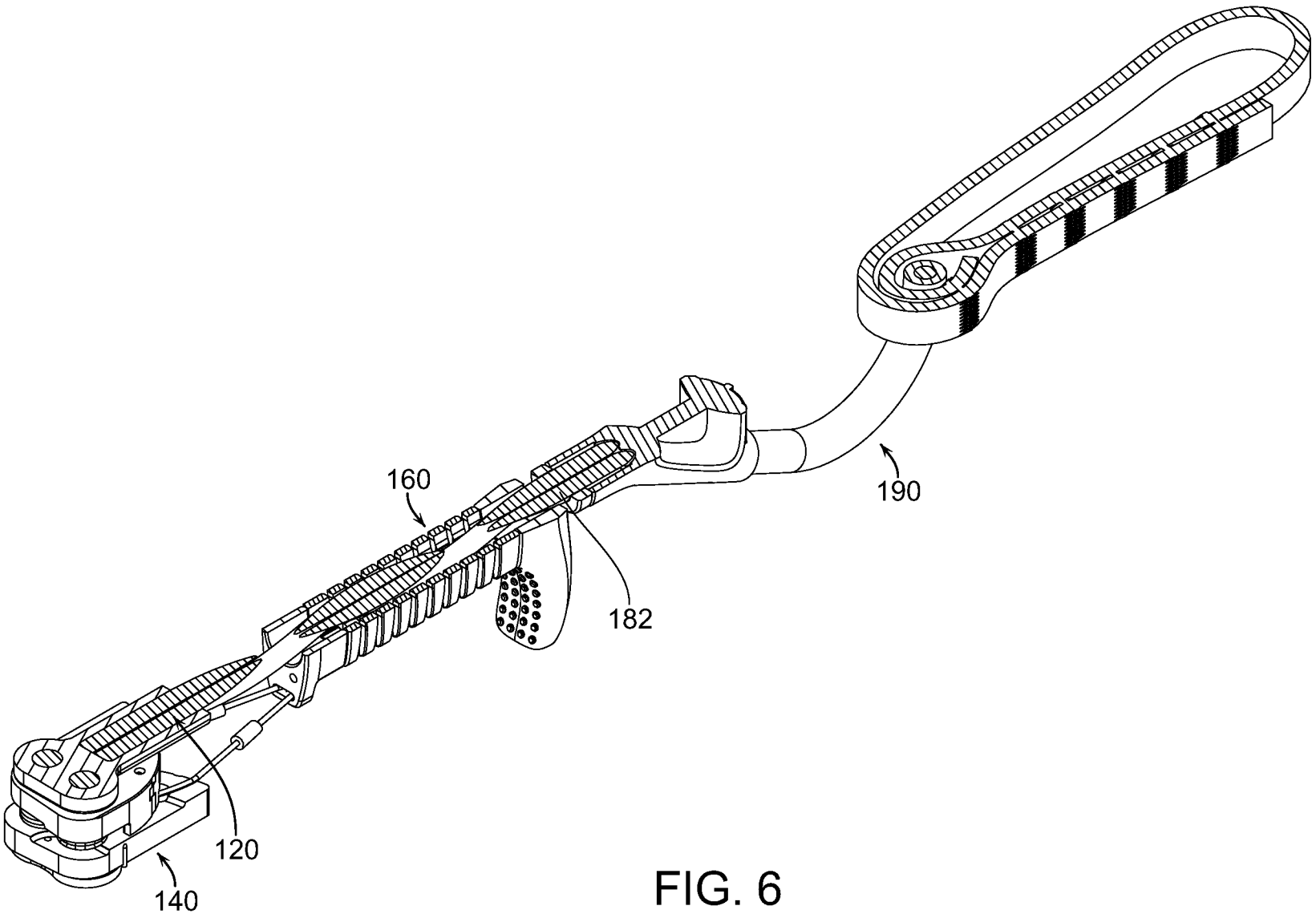
FIG. 6 illustrates an alternative, cross sectional perspective view of a single stem active camming system in a retracted state in accordance with embodiments of the present invention.

Reference is next made to FIG. 3-6, which illustrate various cross-sectional perspective views of the single stem active camming system 100 of FIGS. 1-2. FIGS. 3-4 illustrate vertical cross-sections of the extended and retracted states, while FIGS. 5-6 illustrate horizontal cross-sections of the extended and retracted states. The cross-sectional figures illustrate one embodiment of the twisted cable 182, forming the loop 190 and coupling with the head member 120. The novel orientation of the twisted cable 182 enables the unique functionality that creates the optimal lengthwise rigidity and flexibility of the connection system 180 for operation of the retraction system 160. The novel orientation includes coupling the cable ends 184 to the head member 120 in an orientation orthogonal to both the axles 124 and the loop 190. The novel orientation of the twisted cable 182 further includes orienting the loop 190 parallel to the axles 124. The annotated dashed lines in FIGS. 1 and 5 illustrate the novel inherent geometrical relationship between the cable end 184 couplings, axle 124 orientation, and loop 190 orientation.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes fixably coupling the plurality of cam lobes with a trigger, and wherein the trigger is slidably externally coupled to a connection system; and wherein the connection system is configured to create an elongated partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees.

2. The system of claim 1, wherein a first and second end of the twisted cable are coupled to the head member in an orthogonal orientation to the axle, and wherein the first and second end of the twisted cable are oriented orthogonally with respect to the loop.

3. The system of claim 1, wherein the coupling between the cable and the head member includes a swage coupling.

4. The system of claim 1, wherein the plurality of cam lobes includes four cam lobes.

5. The system of claim 1, wherein the plurality of cam lobes includes three cam lobes.

6. The system of claim 1, wherein the at least one axle includes two axles.

7. The system of claim 1, wherein the at least one axle includes one axle.

8. The system of claim 1, wherein the elongated partially rigid region includes a lengthwise rigidity greater than the cable.

9. The system of claim 1, wherein the elongated partially rigid region is disposed between the loop and the head member.

10. The system of claim 1, wherein the rigidity of the elongated partially rigid region corresponds to the trigger assembly.

11. The system of claim 1, wherein the loop includes a cable cover and a sling, and wherein the cable cover and thumb rest substantially encase a portion of the cable forming the loop.

12. The system of claim 1, wherein the retraction system includes a trigger assembly over the cable disposed between the trigger and the head member.

13. The system of claim 1, wherein the twisted radial angle of at least 90 degrees comprises a twist in the cable disposed between the trigger and the loop in the extended state.

14. The system of claim 1, wherein the cable includes a plurality of fibers.

15. The system of claim 1, wherein the trigger is oriented parallel to the loop.

16. The system of claim 1, wherein the cam lobes are spring biases to the extended state via a plurality of biasing spring coupled to the at least one axle.

17. The system of claim 1, wherein head member further includes a plurality of plates disposed on the end of the at least one axle.

18. The system of claim 1, wherein the head member intercouples the cable and the axle.

19. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes fixably coupling the plurality of cam lobes with a trigger, and wherein the trigger is slidably externally coupled to a connection system; and wherein the connection system is configured to create an elongated partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees, and wherein a first and second end of the twisted cable are coupled to the head member in an orthogonal orientation to the axle, and wherein the first and second end of the twisted cable are oriented orthogonally with respect to the loop.

20. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes fixably coupling the plurality of cam lobes with a trigger, and wherein the trigger is slidably externally coupled to a connection system; and wherein the connection system is configured to create an elongated partially rigid region by intercoupling the head member with a loop, wherein the connection system comprises a twisted cable coupled between the head member and the loop, and wherein the loop is oriented substantially parallel to the at least one axle, and wherein the twisted cable includes a twisting radial angle of at least 90 degrees, and wherein the twisted radial angle of at least 90 degrees comprises a twist in the cable disposed between the trigger and the loop in the extended state.

* * * * *